United States Patent [19]

Briner et al.

[11] Patent Number: 4,509,322

[45] Date of Patent: Apr. 9, 1985

[54] FALSE TWIST UNIT

[75] Inventors: Emil Briner; Richard Hieronymi, both of Winterthur, Switzerland

[73] Assignee: Rieter Machine Works Limited, Winterthur, Switzerland

[21] Appl. No.: 594,240

[22] Filed: Mar. 28, 1984

[30] Foreign Application Priority Data

Apr. 12, 1983 [CH] Switzerland ..... 1961/83

[51] Int. Cl.[3] ..... D01H 5/28; D02G 1/04

[52] U.S. Cl. ..... 57/333; 57/328; 57/350

[58] Field of Search ..... 57/328–331, 57/333, 350, 403, 908

[56] References Cited

U.S. PATENT DOCUMENTS

| | | | |
|---|---|---|---|
| 4,112,658 | 9/1978 | Morihashi | 57/328 |
| 4,124,972 | 11/1978 | Arai et al. | 57/328 |
| 4,183,202 | 1/1980 | Morihashi | 57/328 |
| 4,437,302 | 3/1984 | Anahara et al. | 57/333 |
| 4,450,678 | 5/1984 | Kawabata et al. | 57/333 |
| 4,457,130 | 7/1984 | Sakai et al. | 57/328 |
| 4,476,672 | 10/1984 | Anahara et al. | 57/333 |
| 4,480,434 | 11/1984 | Hiroshi et al. | 57/333 |
| 4,480,435 | 11/1984 | Anahara et al. | 57/333 |

FOREIGN PATENT DOCUMENTS

| | | |
|---|---|---|
| 1130339 | 11/1962 | Fed. Rep. of Germany . |
| 2722319 | 7/1978 | Fed. Rep. of Germany . |
| 572113 | 12/1975 | Switzerland . |
| 617465 | 5/1980 | Switzerland . |
| 1578256 | 11/1980 | United Kingdom . |

*Primary Examiner*—John Petrakes

*Attorney, Agent, or Firm*—Werner W. Kleeman

[57] ABSTRACT

A false twist unit comprises a suction portion with a suction channel and with an expansion space connected at the throat portion or narrowest position of the suction channel, which expansion space is connected by means of an air connector or exit to a source of negative pressure. A throttle location connects the expansion space with a pneumatic twist imparting means. In the pneumatic false twist spinning process known from the German published Pat. No. 2,722,319 a sliver delivered from an exit roller pair of a drafting mechanism is forwarded through the suction channel in a predetermined direction and thereafter through the throttle location into the twist imparting means. The twist imparting means produces in the core of the yarn or thread a false twist which builds up in such yarn or thread towards the exit roller pair. The wrapping fibers required for the finished yarn or thread are sucked in as edge fibers through the suction channel simultaneously with the yarn core. By means of the expansion space the advantage is obtained that the air flow can be sucked away without substantial disturbance to the yarn travel path in a direction substantially at right angles to such yarn travel path.

13 Claims, 13 Drawing Figures

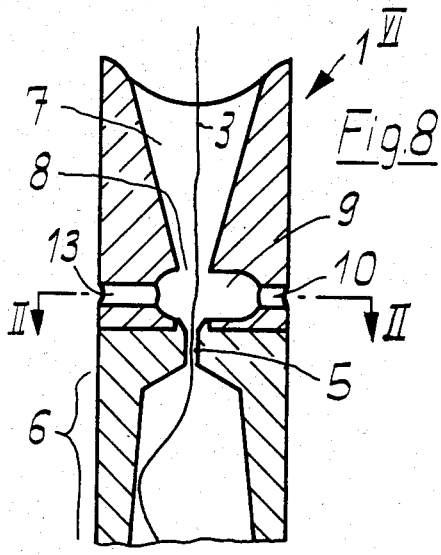
Fig.8
Fig.9
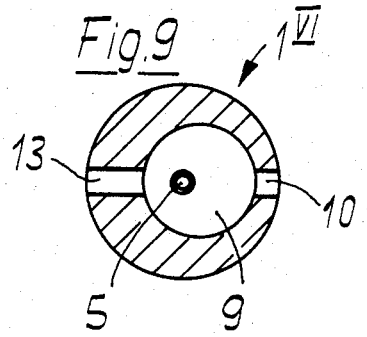
Fig.10
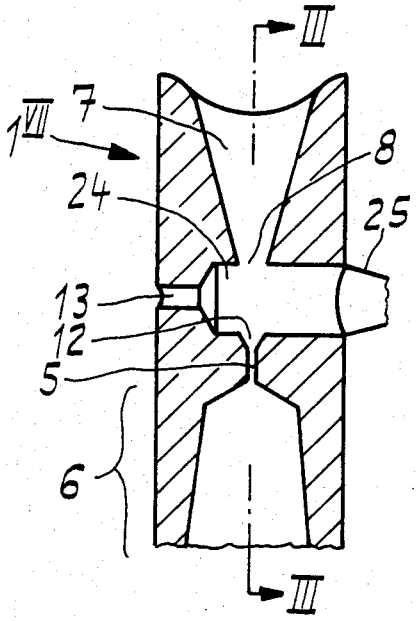
Fig.11
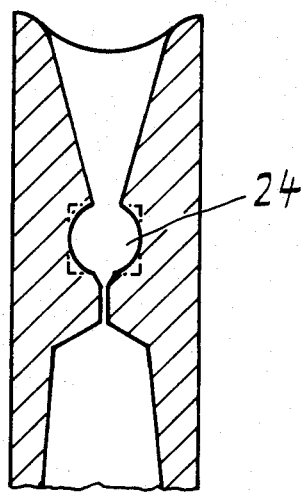

FALSE TWIST UNIT

BACKGROUND OF THE INVENTION

The present invention relates to a false twist unit or device, in particular for false twist spinning, comprising a suction portion containing a converging suction channel or passage and a throttle location or position following thereat, considered with respect to a predetermined direction of yarn or thread movement, and with a twist imparting means following the suction portion.

A false twist unit or device of the above mentioned type is known from Swiss Pat. No. 617,465. With this false twist unit fibers delivered from a drafting mechanism are spun to a yarn or thread or the like. The twist imparting means comprises a pneumatic false twist nozzle by means of which, on the one hand, twist is imparted to the yarn or thread and, on the other hand, air is drawn by suction through the suction channel or passage.

The disadvantage of this prior art arrangement is that the quantity of air drawn through the throttle location or position is insufficient to produce in the suction channel or passage an air speed or velocity which is optimal for the spinning process. The speed or velocity of the air which is required in order to draw in edge or marginal fibers, which in this spinning process are wound around the yarn core, should advantageously be at least greater than the speed of forward movement or advance of the yarn core.

Furthermore, from Swiss Pat. No. 572,113, a device for false twist spinning is known in which a suction portion, arranged before a twisting imparting means as viewed in the direction of travel of the thread or yarn, is provided with a suction channel or passage and a suction tube of approximately equal diameter arranged at right angles thereto.

The disadvantage of this prior art device is that, when a sufficient quantity of air is drawn in by suction, as a result of the considerable diversion of the air stream out of the yarn or thread path, the suction action must be interrupted for starting spinning which makes such so-called start spinning operation correspondingly difficult.

The expression "start spinning" or the like refers to the required guiding of the untwisted fiber sliver delivered by the exit or delivery roller pair into the twist imparting means during the starting-up procedure or operation.

SUMMARY OF THE INVENTION

Therefore, with the foregoing in mind it is a primary object of the present invention to provide a new and improved construction of a false twist unit or device which is not afflicted with the aforementioned drawbacks and shortcomings of the prior art.

Another important object of the present invention is to produce an air suction which, on the one hand, produces a sufficiently high air speed or velocity in the suction channel or passage and, on the other hand, makes possible an essentially problem-free separation of the air stream from the yarn or thread or the like.

Now in order to implement these and still further objects of the invention, which will become more readily apparent as the description proceeds, the false twist unit or device of the present invention is manifested by the features that, the suction portion further comprises a substantially ring-shaped expansion space which is in flow communication with the suction channel or passage and is located before or forwardly of the throttle location or position, so that the suction channel or passage opens at its narrowest position or throat portion into the expansion space, and the expansion space is connected by means of an air exit or outlet to a source of negative or underpressure.

One of the notable advantages of the present invention resides in the fact that through the expansion of the air volume after the narrowest position or throat portion the air velocity or speed reduces substantially in such a manner that, as a result, practically no disturbance is caused to the yarn or fiber movement, by air currents transverse to the yarn movement. Thus, start spinning can be advantageously carried out with the suction being effective. This advantage has beneficial effects both during start spinning and also during operation in that there thus arises less fiber loss.

The advantageous eccentric arrangement of the substantially ring-shaped chamber and/or the use of additional scavenging or flushing air affords the notable advantage that there is less risk of a fiber deposition in the expansion space.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein:

FIG. 8 shows a further modification of the false twist unit of FIGS. 1 or 2;

FIG. 9 shows a cross section of the false twist unit of FIG. 8 taken substantially along the line II—II;

FIG. 10 shows a modification of the false twist unit of FIGS. 1 to 9;

FIG. 11 shows a section of the false twist unit of FIG. 10 taken substantially along the line III—III;

DETAILED DESCRIPTION OF THE PREFERRED EMBODIMENTS

Figure 1:
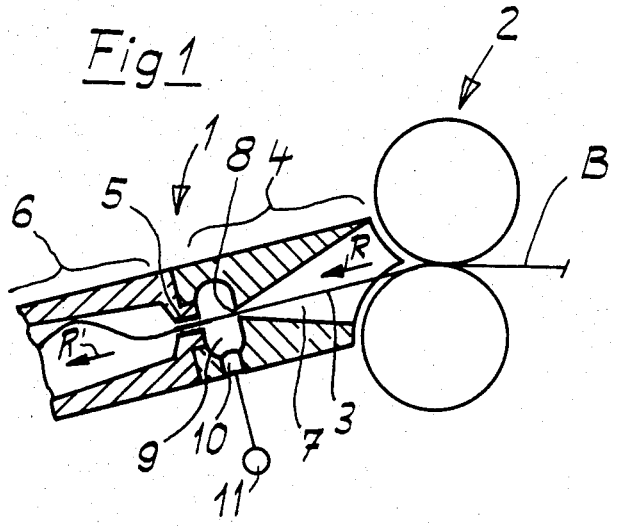
FIG. 1 shows a longitudinal section of the false twist unit or device in accordance with the invention following a drafting mechanism, partially schematically illustrated.

Describing now the drawings, it is to be understood that only enough of the construction of the various exemplary embodiments of the false twist unit or device and its related structure have been shown therein as needed for those skilled in the art to readily understand the underlying principles and concepts of the present development while simplifying the illustration of the drawings. Turning attention now to FIG. 1, there is shown a false twist unit or device 1 which is arranged downstream, considered with respect to the direction of movement R of the yarn or thread 3 or the like, from an exit or delivery roller pair 2 of any suitable here not further shown drafting mechanism.

This false twist unit or device 1 comprises in succession a suction portion 4, a throttle location or position 5 and a twisting imparting means 6. The throttle location or position 5 and the twisting imparting means 6 correspond, for instance, substantially in their construction to the embodiments described in the aforementioned German published patent No. 2,722,319 (corresponding to British Pat. No. 1,578,356), to which reference may be readily had and the disclosure of which is incorporated herein by reference. The actual spinning process is known from this above-mentioned German Patent No. 2,722,319. A sliver B delivered by the exit or delivery roller pair 2 is taken up by a converging suction channel or passage 7 forming part of the suction portion 4 and is drawn, as the result of the suction effect or action of the twist imparting means 6, through the throttle location or position 5. The air stream of the twist imparting means 6, on the one hand, sets the silver B into rotation and, on the other hand, transports it in the direction of thread or yarn movement R'. This rotation produces in the core of the yarn or thread 3 a false twist which builds-up towards the exit or delivery roller pair 2. The fibers to be wrapped around the yarn or thread core, which are required for the finished yarn or thread, are drawn in by suction with the air stream of the suction channel or passage 7.

Importantly, a substantially ring-shaped expansion space or chamber 9 is provided in flow communication with the narrowest position or throat portion 8 of the suction channel or passage 7. This expansion space or chamber 9 is provided with an air exit or outflow 10 which is operatively connected with any suitable source of negative or underpressure 11. The throttle location or position 5 immediately follows this expansion space 9.

The expansion space 9 is so dimensioned that the air passing through the narrowest position or throat portion 8 into this expansion space 9 is calmed and sucked away in such a manner that no substantial disturbance or drift of the yarn or thread 3 and its wrapping fibers occurs in the direction of the air exit or outlet 10.

In the modifications illustrated in FIGS. 2 to 6 and 8, 10 and 12 the elements identical or analogous to those of FIG. 1 are generally indicated with the same reference characters or numerals.

Figure 2:
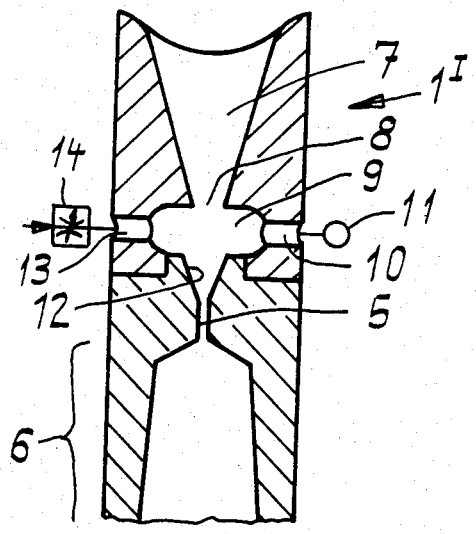
FIGS. 2 to 6 show respective modifications of the false twist unit or device of FIG. 1.

FIG. 2 shows a false twist unit or device $1^{I}$ corresponding to the false twist unit or device 1, but additionally having a funnel 12 located upstream from the throttle location or position 5 and a scavenging or flushing air infeed or inlet 13 which is operatively connected to an adjustable throttle valve 14. The infeed or inlet diameter of the entrance opening of the funnel 12 is advantageously larger than the diameter of the narrowest position or throat portion 8 in order to facilitate threading of the drawn-in yarn or thread 3 into the funnel 12. The exit opening of the funnel 12 forms the throttle location 5.

The scavenging or flushing air infeed or inlet 13 is advantageously located radially opposite the air exit or outlet 10 so that two, substantially symmetrical, semicircular air streams arise, each flowing towards the air exit or outlet 10, thus avoiding settling of the fiber portions in the expansion space or chamber 9. The quantity of scavenging or flushing air necessary for achieving this effect is set by means of the adjustable throttle valve 14 continuously or in steps.

The scavenging or flushing air can also be fed intermittently into the expansion space 9. Furthermore, the scavenging air can be drawn from the spinning region or can be fed as pressurized air and can possibly be air conditioned or climatized.

Figure 3:
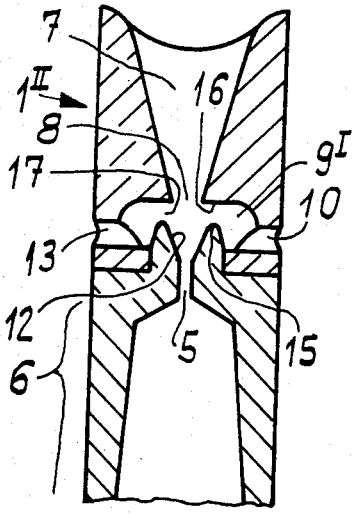

FIG. 3 shows a false twist unit or device $1^{II}$ corresponding to the false twist unit $1^{I}$, but with an expansion chamber or space $9^{I}$ into which a ring-shaped projection or bead 15 extends to form the funnel 12. The advantage of this ring-shaped projection 15 is that the two previously mentioned air streams flow in a more emphatically semi-circular fashion towards the air exit or outlet 10 and thus fewer disturbing air streams can arise directed at right angles to the thread travel path since the air leaving the narrowest position or throat portion 8 flows in substantially circular fashion into the expansion space $9^{I}$ through a substantially cylindrical ring-shaped air throughflow section 17 formed between the ring-shaped projection 15 and the wall 16 defining or bounding the narrowest position or throat portion 8.

Figure 4:
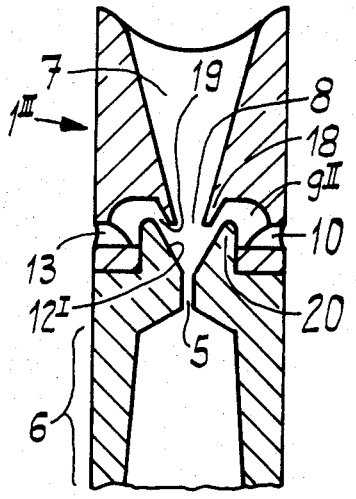

FIG. 4 shows a further modification of a false twist unit or device $1^{III}$ in which the air leaving the narrowest position or throat portion 8 is additionally further diverted, in comparison with the embodiment of FIG. 3, before it passes into the expansion space or chamber $9^{II}$. This diversion is produced by a substantially conical extension 18 forming the narrowest position or throat portion 8, which conical extension 18 projects into a funnel $12^{I}$ and thus forms a substantially conical annular ring-shaped gap or air throughflow section 19. The funnel $12^{I}$ is formed at least partially by a projection or bead 20 extending into the expansion space $9^{II}$. In comparison with the embodiment of FIG. 3 this diversion additionally reduces the disturbing flows passing across the yarn or thread travel path.

Figure 5:
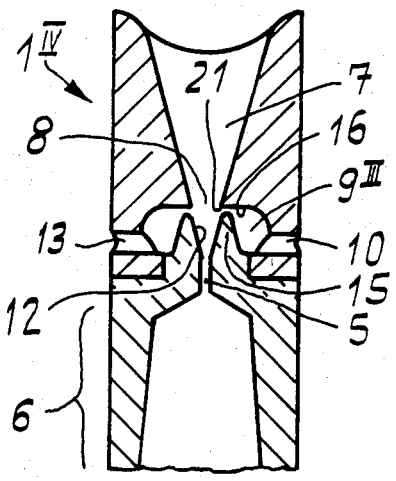

The false twist unit or device $1^{IV}$ of FIG. 5 generally corresponds to the embodiment of FIG. 3 with the difference that the projection or bead 15 extends so far towards the boundary wall 16 that an air throughflow section 21 formed therebetween has a smaller area or surface than the narrowest position or throat portion 8. The difference can be very small; it will suffice that the air resistance of the cross section or air throughflow section 21 is greater than that of the narrowest position or throat portion 8.

If the area of the annular gap defined by the air throughflow section 21 is substantially smaller than the narrowest position or throat portion 8, then disturbing flows transverse to the yarn or thread travel path are beneficially avoided.

Figure 6:
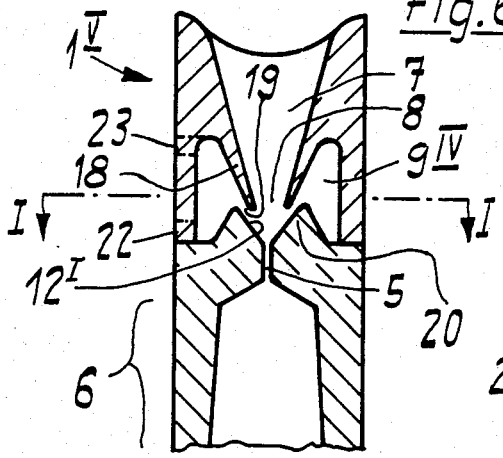
Figure 7:
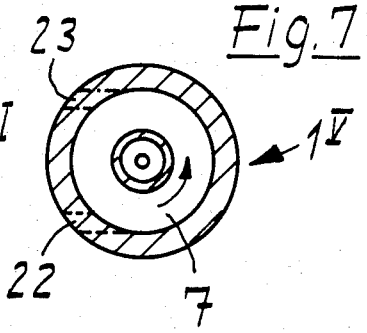
FIG. 7 shows a cross section of the false twist unit of FIG. 6 taken substantially along the line I—I thereof.

FIGS. 6 and 7 show a further embodiment constituting a variant of the embodiment of FIG. 4 with an expansion space $9^{IV}$ of increased height in comparison with the expansion space $9^{II}$. In the expansion space or chamber $9^{IV}$ there is a tangential air inflow or inlet 22 in the region of the projection 20 and a tangential air exit or outflow 23 in the region of such expansion space $9^{IV}$ lying opposite to the region of the projection 20 as viewed in the axial direction of the false twist unit $1^{V}$. Air inflow or inlet 22 and air exit or outflow 23 are so arranged that the scavenging or flushing air entering at the air inflow or inlet 22 flows along a substantially spiral path towards the air outflow or exit 23 and thereby sets the air entering through the annular gap 19 into additional rotation in the same direction as the core yarn. The drawn-in air is already subjected to a certain degree of rotation because of the rotation of the core yarn.

This measure has the advantage that it opposes to an increased degree the tendency to deposition of fibers in the expansion spaces or chambers $9^{I}$, $9^{II}$, $9^{III}$ and $9^{IV}$ illustrated in FIGS. 3 to 6.

A further measure for reduction or avoidance of fiber deposits in the expansion spaces 9 to $9^{IV}$ is illustrated for the expansion space 9 in the embodiment of FIGS. 8 and 9.

The measure is that, as depicted for the false twist unit or device $1^{VI}$ of FIGS. 8 and 9 the expansion space 9 is arranged eccentric to the yarn lengthwise axis (not shown) or the yarn travel path 3 such that even at the position with the smallest air quantity corresponding to the direction of flow a sufficiently high air speed or velocity is produced to avoid fiber deposits.

Furthermore, FIGS. 10 to 13 show that non-ring-shaped expansion spaces can also be beneficially used.

In these FIGS. 10 to 13, elements already previously illustrated are generally indicated with the same reference characters or numerals.

FIGS. 10 and 11 illustrate a false twist unit or device $1^{VII}$ with a substantially cylindrical expansion space or chamber 24 and an air outflow or exit 25 connected thereto.

The expansion space 24 can, however, and as indicated with dotted lines in FIG. 11, have a substantially square cross-section, if desired a rectangular or another angular or multi-cornered configuration or cross-section.

Figure 12:
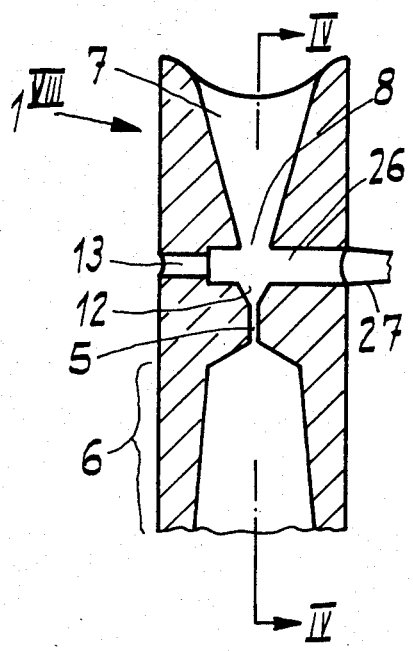
FIG. 12 shows a still further modification of the false twist unit of FIGS. 1 to 9, partially schematically illustrated.
Figure 13:
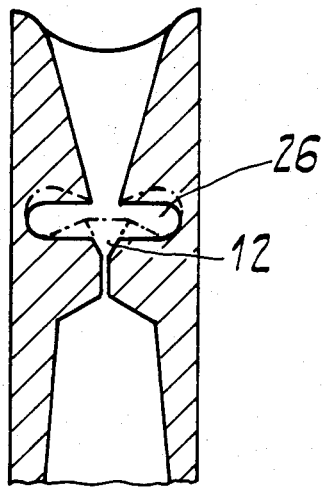
FIG. 13 shows a section of the false twist unit of FIG. 12 taken substantially along the line IV—IV.

FIGS. 12 and 13 show a further variant embodiment of a false twist unit or device $1^{VIII}$ in which an expansion space or chamber 26 is provided which, as shown in FIG. 13, has a substantially oval cross-section. An air outflow or exit 27 connected thereto serves as a connection to a suitable suction unit (not shown).

Instead of the substantially oval cross-section, the cross-section can be so formed, as indicated with chain-dot lines in FIG. 13, that the air inflow section (not illustrated) which is traversed by the air flowing from the narrowest position or throat portion 8 into the expansion space 26, is formed in such a manner and functions in a manner as shown and described with reference to FIGS. 3 to 6.

The advantage of the non-ring-shaped section is that thereby the expansion space can be formed or machined into the full or solid false twist unit, that is into a unit which is not divided into two parts.

While there are shown and described present preferred embodiments of the invention, it is to be distinctly understood that the invention is not limited thereto, but may be otherwise variously embodied and practiced within the scope of the following claims. Accordingly,

What we claim is:

1. A false twist unit for threads or the like having a predetermined direction of thread movement, in particular for false twist spinning, comprising:

a suction portion containing a converging suction channel including a throat portion;

means defining a throttle location following said converging suction channel considered with respect to the predetermined direction of thread movement;

twist imparting means following the suction portion with respect to said predetermined direction of thread movement;

said suction portion further containing an expansion space which is in flow communication with the suction channel and located forwardly of the throttle location so that the suction channel opens at its throat portion into said expansion space;

means defining an air exit for said expansion space;

means defining a source of negative pressure; and said expansion space being connected by said air exit to said source of negative pressure.

2. The false twist unit according to claim 1, further including:

a funnel connected to the expansion space in said predetermined direction of thread movement;

said funnel having an exit opening and an entrance opening;

said exit opening of said funnel forming said throttle location; and said entrance opening of said funnel corresponding at least to said throat portion of the suction channel.

3. The false twist unit according to claim 1, wherein: the expansion space has an air inlet opening.

4. The false twist unit according to claim 3, wherein: said air inlet opening and said air exit are arranged in two imaginary planes separated from one another and disposed at substantially right angles to a lengthwise axis of the thread.

5. The false twist unit according to claim 3, further including:

a throttle valve operatively associated with the air inlet opening.

6. The false twist unit according to claim 1, wherein: the expansion space is substantially ring-shaped.

7. The false twist unit according to claim 6, further including:

a funnel connected to the expansion space in said predetermined direction of thread movement;

said funnel having an exit opening and an entrance opening;

said exit opening of said funnel forming said throttle location;

said entrance opening of said funnel corresponding at least to the throat portion of the suction channel; and a substantially ring-shaped projection forming said funnel projecting into said expansion space to thereby form a substantially cylindrical ring-shaped air throughflow section.

8. The false twist unit according to claim 7, wherein: the throat portion and the substantially cylindrical ring-shaped air throughflow section are structured such that the air resistance of the throat portion is smaller than the resistance of the substantially ring-shaped air throughflow section.

9. The false twist unit according to claim 6, further including:

a funnel connected to the expansion space in said predetermined direction of thread movement;

said funnel having an exit opening and an entrance opening;

said exit opening of said funnel forming said throttle location;

said entrance opening of said funnel corresponding at least to the throat portion of the suction channel; and an extension containing said throat portion projecting into the funnel to thereby form a substantially conical ring-shaped air throughflow section.

10. The false twist unit according to claim 9, wherein:

the throat portion and the substantially conical air throughflow section are structured such that the air resistance of the throat portion is smaller than the resistance of the substantially conical air throughflow section.

11. The false twist unit according to claim 6, wherein: the expansion space has an air inlet opening; and said air inlet opening and said air exit are arranged such that air in the extension space is set into rotation about a lengthwise axis of the thread.

12. The false twist unit according to claim 1, wherein: the expansion space is arranged eccentric to a lengthwise axis of the thread such that the speed of an air flow in the expansion space in the direction of the air exit remains substantially constant.

13. The false twist unit according to claim 1, wherein: the expansion space is other than ring-shaped.

* * * * *

UNITED STATES PATENT AND TRADEMARK OFFICE

CERTIFICATE OF CORRECTION

PATENT NO. : 4,509,322

DATED : April 9, 1985

INVENTOR(S) : EMIL BRINER et al

It is certified that error appears in the above—identified patent and that said Letters Patent is hereby corrected as shown below:

Column 3, line 21, please delete "silver" and insert --sliver--

Signed and Sealed this

*Seventeenth* Day of *September 1985*

[SEAL]

*Attest:*

*Attesting Officer*

DONALD J. QUIGG

*Commissioner of Patents and Trademarks—Designate*